US009601074B2

(12) United States Patent
Fujioka et al.

(10) Patent No.: US 9,601,074 B2
(45) **Date of Patent: *Mar. 21, 2017**

(54) DRIVE DEVICE AND DISPLAY DEVICE

(71) Applicant: Sharp Kabushiki Kaisha, Osaka-shi, Osaka (JP)

(72) Inventors: Akizumi Fujioka, Osaka (JP); Toshihiro Yanagi, Osaka (JP); Satoshi Ihida, Osaka (JP); Kazuki Takahashi, Osaka (JP); Taketoshi Nakano, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/159,924

(22) Filed: May 20, 2016

(65) Prior Publication Data

US 2016/0267870 A1 Sep. 15, 2016

Related U.S. Application Data

(63) Continuation of application No. 14/375,837, filed as application No. PCT/JP2013/053333 on Feb. 13, 2013, now Pat. No. 9,378,697.

(30) Foreign Application Priority Data

Feb. 20, 2012 (JP) ..... 2012-034516

(51) Int. Cl.
*G09G 3/36* (2006.01)

(52) U.S. Cl.
CPC ..... *G09G 3/3677* (2013.01); *G09G 3/3648* (2013.01); *G09G 3/3674* (2013.01); (Continued)

(58) Field of Classification Search
CPC ..... G09G 3/3674; G09G 3/3648; G09G 2320/043; G09G 2310/067; G09G 2340/0435; G09G 2330/021
See application file for complete search history.

(56) References Cited

U.S. PATENT DOCUMENTS

2002/0015031 A1 2/2002 Fujita et al.
2002/0093473 A1 * 7/2002 Tanaka ..... G09G 3/3648 345/87

(Continued)

FOREIGN PATENT DOCUMENTS

JP 2002-108309 A 4/2002
JP 5833219 B2 12/2015
WO 2011/145360 A1 11/2011

OTHER PUBLICATIONS

Fujioka et al., "Drive Device and Display Device", U.S. Appl. No. 14/375,837, filed Jul. 31, 2014.

*Primary Examiner* — Kevin M Nguyen
*Assistant Examiner* — Amy C Onyekaba
(74) *Attorney, Agent, or Firm* — Keating & Bennett, LLP

(57) ABSTRACT

Included are: refresh a rate changing section (15) for changing a refresh rate of a display panel (2) by configuring settings for scan periods during each of which a plurality of gate signal lines (G) of the display panel (2) are sequentially scanned and for pause periods during each of which sequential scanning of the plurality of gate signal lines (G) is suspended; and a drive amount control section (20) for controlling, in accordance with a ratio of the scan periods to the pause periods, drive time during which each of the gate signal lines is driven in each of the scan periods.

7 Claims, 7 Drawing Sheets

(52) U.S. Cl.
CPC . *G09G 2310/062* (2013.01); *G09G 2310/067* (2013.01); *G09G 2310/08* (2013.01); *G09G 2320/0247* (2013.01); *G09G 2320/043* (2013.01); *G09G 2330/021* (2013.01); *G09G 2340/0435* (2013.01)

(56) References Cited

U.S. PATENT DOCUMENTS

| | | | | |
|---|---|---|---|---|
| 2009/0122087 | A1* | 5/2009 | Maruyama | G09G 3/3611 345/690 |
| 2011/0148826 | A1* | 6/2011 | Koyama | G09G 3/3696 345/204 |
| 2011/0267381 | A1* | 11/2011 | Yamazaki | G09G 3/3607 345/690 |
| 2013/0050146 | A1 | 2/2013 | Saitoh et al. | |
| 2014/0368492 | A1 | 12/2014 | Fujioka et al. | |

* cited by examiner

FIG. 7

| RESOLUTION | ON RATIO [%] | STABILITY OF THRESHOLD Vth OF ELEMENT SUCH AS IGZO |
|---|---|---|
| VGA 640× 480 | 0.17 | VERY GOOD |
| XGA 1024× 768 | 0.11 | GOOD |
| FHD 1920×1080 | 0.08 | FAIR |
| QXGA 2048×1536 | 0.05 | POOR |
| QFHD 3840×2160 | 0.04 | POOR |
| 8K4K 7680×4320 | 0.02 | POOR |

DRIVE DEVICE AND DISPLAY DEVICE

TECHNICAL FIELD

The present invention relates to drive devices and display devices.

BACKGROUND ART

In recent year, comparatively thin display devices such as liquid crystal display devices have been widely used in various types of information terminal such as electronic book terminals, smartphones, cellular phones, PDAs (portable information terminals), laptop personal computers, portable game machines, and car navigation apparatuses. These display devices are accompanied by issues such as reduction in electric power consumption and improvement in display image quality. Under such circumstances, there have been proposed various technologies intended to solve these issues accompanying display devices.

An example of a technology for improving display image quality is a method of raising a refresh rate. For example, increasing the refresh rate from "60 Hz (i.e. 60 fps)" to "120 Hz (i.e. 120 fps)" in displaying a moving image makes it possible to express a smoother movement and restrain a display defect such as flicker from occurring.

However, as the refresh rate rises, the number of times the display panel is scanned increases accordingly. This results in increased electric power consumption. For this reason, in a case where more emphasize is put on reduction in electric power consumption than on improvement in display image quality, a technology of lowering the refresh rate may be used.

For example, Patent Literature 1, listed below, discloses a technology for reducing electric power consumption by actively speeding up the refresh rate during a time when a pseudo-contour is likely to appear or during a display of a picture in which such a pseudo-contour is conspicuous and by actively lowering the refresh rate in a case where a pseudo-contour is unlikely to appear or in the case of a picture in which a pseudo-contour, if any, is inconspicuous.

Meanwhile, it has been known about liquid crystal display devices that when the write time is of short duration with respect to the response time of liquid crystals, there is a decrease in the rate of voltage retention of the liquid crystals, and the decrease eventually leads to a reduction in contrast ratio. Especially in recent years, since there has been a remarkable increase in resolution of display panels and, accordingly, there has been shortening of the time required to write to each scanning line, such a problem has been likely to take place.

In order to solve such a problem, Patent Literature 2, listed below, discloses a technology for raising the rate of voltage retention of liquid crystals by performing writing twice on each scanning line with a two-wire simultaneous drive method (double scanning).

CITATION LIST

Patent Literature 1

Japanese Patent Application Publication, Tokukai, No. 2010-145810 A (Publication Date: Jul. 1, 2010)

Patent Literature 2

Japanese Patent Application Publication, Tokukaihei, No. 10-96893 A (Publication Date: Apr. 14, 1998)

SUMMARY OF INVENTION

Technical Problem (Example of Change of the Refresh Rate by a Conventional Display Device)

An example of change of the refresh rate by a conventional display device is described here with reference to FIG. 5. FIG. 5 shows an example of change of the refresh rate by a conventional display device.

(a) to (c) of FIG. 5 show configurations of frame periods and pulse waveforms of drive pulses on gate signal lines during the frame periods. Of (a) to (c) of FIG. 5, (a) of FIG. 5 shows a time of normal driving. Further, (b) of FIG. 5 shows a time of change of the refresh rate (to ½ of the refresh rate during normal driving). Further, (c) of FIG. 5 shows a time of change of the refresh rate (to ⅓ of the refresh rate during normal driving).

Meanwhile, in (a) to (c) of FIG. 5, Vsync represents the pulse waveform of a vertical synchronization signal that is generated every frame period. Further, Vg(0) represents the pulse waveform of a drive pulse on the first (leading) gate signal line. Further, Vg(m) represents the pulse waveform of a drive pulse on the mth gate signal line. Moreover, Vg(M) represents the pulse waveform of a drive pulse on the Mth (last) gate signal line.

The example shown in FIG. 5 is a case where the refresh rate of a display panel is changed by a conventional display device by providing frame periods (hereinafter referred to as "pause periods") during which the plurality of gate signal lines are not scanned.

For example, during normal driving (i.e. driving of the display panel at the standard refresh rate) in the conventional display device, there is provided a continuous series of frame periods (hereinafter referred to as "scan periods") during which the plurality of gate signal lines are scanned (see (a) of FIG. 5). For example, in a case where the refresh rate during normal driving is 60 Hz, there is provided a series of sixty scan periods per second.

Moreover, the conventional display device changes some of the frame periods to pause periods in changing the refresh rate. For example, in changing the refresh rate from 60 Hz to 30 Hz, the conventional display device alternates a scan period and a pause period (see (b) of FIG. 5) by changing appropriate ones of the plurality of frame periods during normal driving from scan periods to pause periods so that the ratio of scan periods to pause periods is 1:1. This causes the number of times the plurality of gate signal lines are scanned per second to be 30, thus causing the refresh rate of the display panel to be changed from 60 Hz to 30 Hz.

Similarly, in changing the refresh rate from 60 Hz to 20 Hz, the conventional display device alternates a scan period and two pause periods (see (c) of FIG. 5) by changing appropriate ones of the plurality of frame periods during normal driving from scan periods to pause periods so that the ratio of scan periods to pause periods is 1:2. This causes the number of times the plurality of gate signal lines are scanned per second to be 20, thus causing the refresh rate of the display panel to be changed from 60 Hz to 20 Hz.

By thus changing the refresh rate by providing pause periods, the period of time required to scan the display panel can be shortened. Moreover, doing so can better reduce electric power consumption than changing the refresh rate by adjusting the length of a scan period.

It should be noted here that as shown in (a) to (c) of FIG. 5, there is no difference between the length of a drive period (period during which an ON voltage (Hi level voltage) is applied) of each gate signal line before the change of the refresh rate and that after the change of the refresh rate. On the other hand, there is a difference between the length of a non-drive period (period during which an OFF voltage (Lo level voltage) is applied) of each gate signal line before the change of the refresh rate and that after the change of the refresh rate.

For example, in the examples shown in (a) to (c) of FIG. 5, the pulse number of drive pulses on each gate signal line is "1" regardless of the refresh rata, and its pulse width remains fixed.

As opposed to this, for example, in the case of the change of the refresh rate to ½ (e.g. from 60 Hz to 30 Hz), where a scan period and a pause period are alternated so that the ratio of scan periods to pause periods is 1:1, the length of a non-drive period of each gate signal line is extended to a period equal in length to two pause periods (e.g. 2/60 second).

Alternatively, in the case of the change of the refresh rate to ⅓ (e.g. from 60 Hz to 20 Hz), where a scan period and two pause periods are alternated so that the ratio of scan periods to pause periods is 1:2, the length of a non-drive period of each gate signal line is extended to a period equal in length to three pause periods (e.g. 3/60 second).

Thus employing a configuration in which the refresh rate is changed by providing pause periods, the conventional display device suffers from fluctuation in duty ratio (hereinafter referred to as "ON/OFF ratio") between the length of a drive period of each gate signal line and the length of a non-drive period of each gate signal line. Especially in recent years, since there has recently been improvement in the OFF characteristics of the switching elements of pixels and, accordingly, it has become possible to lengthen a pause period, such fluctuation in the ON/OFF ratio has been likely to take place.

Further, simply increasing the number of times writing is performed on each gate signal line during scanning, as described in Patent Literature 2, listed above, ends up with fluctuation in the ON/OFF ratio of each gate signal line.

Moreover, such fluctuation in the ON/OFF ratio invites fluctuation in threshold voltage of the switching elements constituting the respective pixels.

The switching element in each pixel is designed to operate at a predetermined ON voltage and a predetermined OFF voltage when the switching element is made to operate at a predetermined ON/OFF ratio. For this reason, as described above, greatly changing the refresh rate of the display panel or increasing the number of time writing is performed on each gate signal line during scanning causes the ON/OFF ratio of each switching element to be greatly changed, too, thereby causing a variation in threshold voltage of each switching element. This in turn disables each switching element to operate at a predetermined ON voltage and a predetermined OFF voltage.

(Fluctuations in the Threshold Voltage of a Switching Element)

Now, an example of fluctuations in the threshold voltage of a switching element due to fluctuations in the ON/OFF ratio of the switching element is described with reference to FIGS. 6 and 7. FIG. 6 is a diagram showing the characteristics of a switching element that is used in a pixel of a display panel. FIG. 7 is a table showing the ON/OFF ratio of the switching element and the stability of a threshold voltage Vth at each level of image resolution of the display panel. FIGS. 6 and 7 show an example where paused driving as a method of driving.

As shown in FIG. 7, in a case where a switching element is used in a display panel of a VGA size (640×480 pixels), the ON/OFF ratio of the switching element is "0.17%". In this case, as it is shown in FIG. 7 that the stability of the threshold voltage Vth is "Very Good", the switching element can be made to operate normally.

For example, as shown in FIG. 6, when a predetermined voltage Vgh is applied, the threshold voltage Vth stabilizes in an ON state, and in a case where a predetermined voltage Vg1 is applied, the threshold voltage Vth stabilizes in an OFF state. That is, this shows that the switching element stably operates at the voltage Vgh and the voltage Vg1 when used in a display panel in which its ON/OFF ratio is "0.17%".

Meanwhile, as shown in FIG. 7, with the increase in image resolution of display panels, e.g. XGA size (1024×768 pixels), FHD size (1920×1080 pixels), QXGA size (2048×1536 pixels), QFHD size (3840×2160 pixels), and 8 K4 K size (7680×4320 pixels), the ON/OFF ratio becomes gradually smaller, e.g. "0.11%", "0.08%", "0.05%", "0.04%", and "0.02%".

In this case, as shown in FIG. 6, as the ON/OFF ratio becomes smaller, the threshold voltage Vth shifts toward lower voltages. If this shift amount is large, the switching element becomes unable to operate normally. For example, when the ON/OFF ratio becomes "0.08%" or smaller, the switching element becomes unable to be made to operate normally, as it is shown in FIG. 7 that the stability of the threshold voltage Vth is "Fair" or "Poor".

For example, there will be such a defect that the switching element does not switch from the ON state to the OFF although the voltage Vg1 has been applied.

Such a defect in the switching element due to a drop in the ON/OFF ratio can take place not only in a case where the image resolution of the display panel has been increased, but also in a case where the ratio of scan periods to pause periods has been changed due to change of the refresh rate, as described with reference to FIG. 5.

The present invention has been made in view of the foregoing problems, and it is an object of the present invention to provide a display device in which a defect in operation of a switching element due to change of the refresh rate of a display panel is unlikely to take place.

Solution to Problem

In order to solve the aforementioned problems, a drive device according to the present invention is a drive device for driving a display panel having a plurality of pixels, including: refresh rate changing means for changing a refresh rate of the display panel by configuring settings for scan periods during each of which a plurality of gate signal lines of the display panel are sequentially scanned and for pause periods during each of which sequential scanning of the plurality of gate signal lines is suspended; and drive amount control means for controlling, in accordance with a ratio of the scan periods to the pause periods, drive time during which each of the gate signal lines is driven in each of the scan periods.

Advantageous Effects of Invention

The present invention makes it possible to change the ON/OFF ratio of each switching element to a more appropriate one according to a change of the refresh rate of the display panel, thereby making it possible to suppress shifts in threshold voltage of the switching elements. This makes it possible to provide a display device in which a defect in operation of a switching element due to change of the refresh rate of a display panel is unlikely to take place.

BRIEF DESCRIPTION OF DRAWINGS

FIG. 7 is a table showing the ON/OFF ratio of a switching element and the stability of a threshold voltage at each level of image resolution of a display panel.

DESCRIPTION OF EMBODIMENTS

Embodiment 1

Embodiments of the present invention are described with reference to the drawings. First, Embodiment 1 of the present invention is described.

(Configuration of a Display Device)

Figure 1:
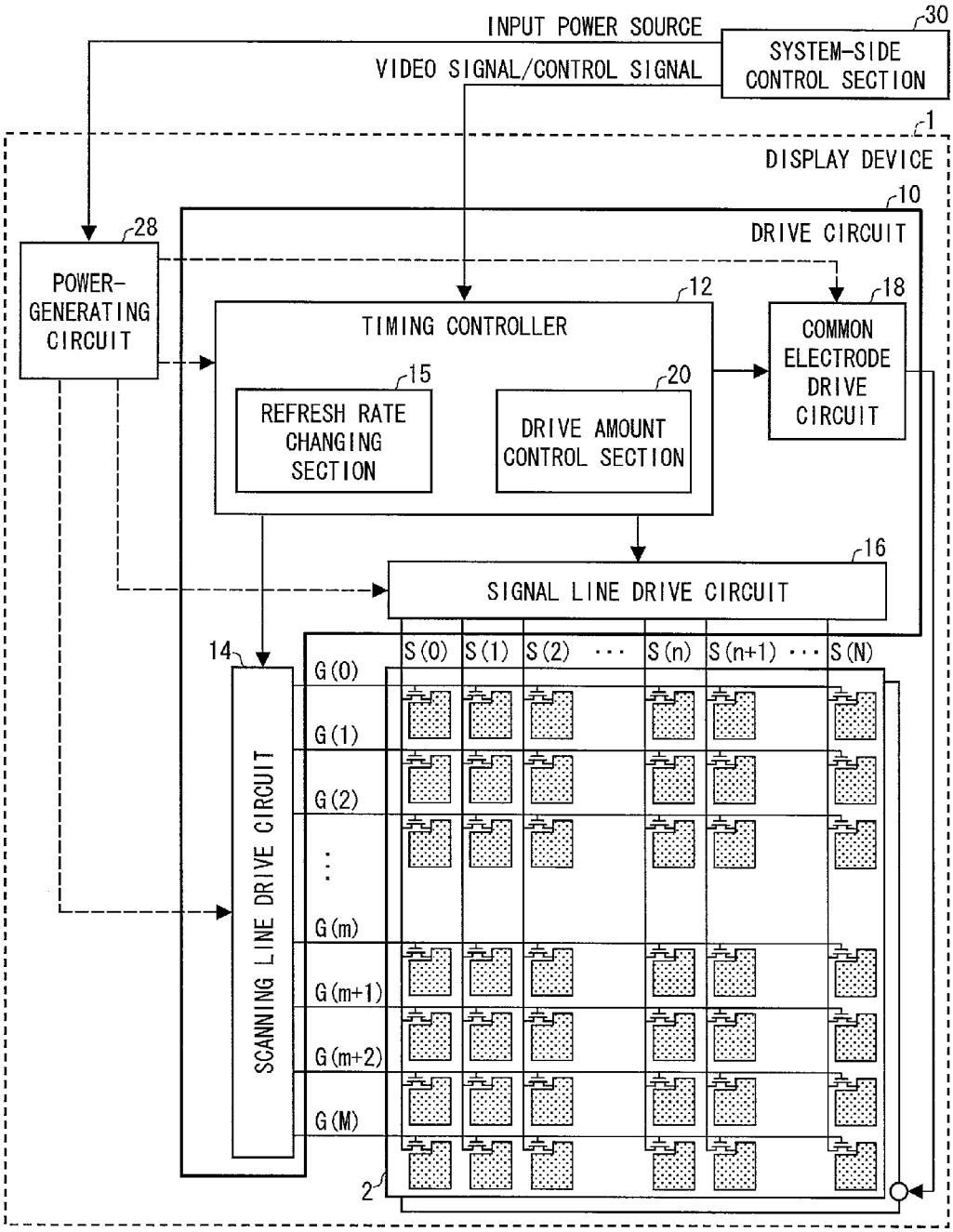
FIG. 1 is a diagram showing an overall configuration of a display device according to Embodiment 1.

First, an example configuration of a display device 1 according Embodiment 1 is described with reference to FIG. 1. FIG. 1 is a diagram showing an overall configuration of the display device according to Embodiment 1.

As shown in FIG. 1, the display device 1 includes a display panel 2, a display drive circuit 10, and a power-generating circuit 28. Of these components, the display drive circuit 10 includes a timing controller 12, a scanning line drive circuit 14, a signal line drive circuit 16, and a common electrode drive circuit 18.

The display device 1 is mounted as a display device in an electronic book terminal, a smartphone, a cellular phone, a PDA, a laptop personal computer, a portable game machine, a car navigation apparatus, or the like to display various types of information. The present embodiment employs an active-matrix liquid crystal display device as the display device 1. Therefore, the display panel 2 of the present embodiment is an active-matric liquid crystal display panel, and the other components named above are configured to drive such a liquid crystal display panel.

(Display Panel)

The display panel 2 includes a plurality of pixels, a plurality of gate signal lines G, and a plurality of source signal lines S.

The plurality of pixels are arranged in so-called gridlike fashion, i.e. in rows and columns of pixels.

The plurality of gate signal lines G laid side by side in a column-wise direction (along the columns of pixels). Each of the plurality of gate signal lines G is electrically connected to its corresponding ones of the pixels belonging to the plural rows of pixels.

The plurality of source signal lines S laid side by side in a row-wise direction (along the rows of pixels) in parallel with each other, and are orthogonal to the plurality of gate signal lines G. Each of the plurality of source signal lines S is electrically connected to its corresponding ones of the pixels belonging to the plural columns of pixels.

In the example shown in FIG. 1, the display panel 2 is provided with a plurality of pixels arranged in N columns and M rows and, accordingly, provided with N source signal lines S and M gate signal lines G.

(Scanning Line Drive Circuit)

The scanning line drive circuit 14 scans the plurality of gate signal lines G in a sequential selection manner. Specifically, the scanning line drive circuit 14 selects a gate signal line G from among the plurality of gate signal lines G in sequence and supplies, to the gate signal line G thus selected, an ON voltage for switching ON the switching elements (TFTs) provided in the respective pixels on that gate signal line G.

(Signal Line Drive Circuit)

While a gate signal line G is being selected, the signal line drive circuit 16 supplies source signals corresponding to image data to the respective pixels on that gate signal line G through the corresponding source signal lines S. Specifically, the signal line drive circuit 16 calculates, on the basis of a video signal inputted, the values of voltages to be outputted to the respective pixels on the gate signal line G selected, and outputs the voltages of the values to the respective source signal lines S from a source output amplifier (not illustrated). Consequently, the source signals are supplied to the respective pixels on the gate signal line G selected, whereby these source signals are written.

(Common Electrode Drive Circuit)

The common electrode drive circuit 18 supplies, to a common electrode provided for each of the plurality of pixels, a predetermined common voltage for driving the common electrode.

(Timing Controller)

The timing controller 12 receives a video signal and a control signal from an outside source (in the example shown in FIG. 1, a system-side control section 30, which does not imply any limitation). The "video signal" as used herein encompasses a clock signal, a synchronization signal, and an image data signal. Further, the control signal may contain an instruction to change the refresh rate. Then, in accordance with the video signal and the control signal, the timing controller 12 outputs, to each of the drive circuits, various types of control signal in synchronization with which the drive circuit operates, as indicated by solid arrows in FIG. 1.

For example, the timing controller 12 supplies a gate start pulse signal, a gate clock signal GCK, and a gate output control signal GOE to the scanning line drive circuit 14. Upon receiving the gate start pulse signal, the scanning line drive circuit 14 starts to scan the plurality of gate signal lines G. Then, the scanning line drive circuit 14 supplies an ON voltage to each of the gate signal lines G in sequence in accordance with the gate clock signal GCK and the gate output control signal GOE.

Further, the timing controller 12 outputs a source start pulse signal, a source latch strobe signal, and a source clock signal to the signal line drive circuit 16. On the basis of the source start pulse signal, the signal line drive circuit 16 stores each of the items of image data inputted to the respective pixels in a register in accordance with the source clock signal, and then supplies source signals corresponding to the image data to the respective source signal lines S in accordance with the next source latch strobe signal.

(Power-Generating Circuit)

The power-generating circuit 28 generates, from an input power source supplied from an outside source (in the example shown in FIG. 1, the system-side control section 30, which does not imply any limitation), voltages that are required by the scanning line drive circuit 14, the signal line drive circuit 16, and the common electrode drive circuit 18, respectively. Then, as indicated by dotted arrows in FIG. 1, the power-generating circuit 28 supplies the voltages thus generated to the scanning line drive circuit 14, the signal line drive circuit 16, and the common electrode drive circuit 18, respectively.

(Further Functions of the Display Device 1)

Now, a further function of the display device 1 is described. The display device 1 further includes a refresh rate changing section 15 and a drive amount control section 20. In the example shown in FIG. 1, the refresh rate changing section 15 and the drive amount control section 20 are provided in the timing controller 12. However, this does not imply any limitation. The refresh rate changing section 15 and the drive amount control section 20 may be provided in a circuit or the like other than the timing controller 12.

(Refresh Rate Changing Section 15)

The refresh rate changing section 15 changes the refresh rate of the display panel 2. The refresh rate is the frequency with which a display on the display panel is rewritten. For example, in a case where the refresh rate is "60 Hz", a display on the display panel 2 is rewritten sixty times per second (i.e. sixty frames are displayed per second), and in a case where the refresh rate is "30 Hz", a display on the display panel 2 is rewritten thirty times per second (i.e. thirty frames are displayed per second).

Generally, the higher the refresh rate of a display panel is, the better the display image quality of the display panel is. However, the higher the refresh rate is, the more frequently a display is rewritten. Therefore, the higher the refresh rate is, the higher the electric power consumption is. Given this, for example, the refresh rate may be set high in case where display image quality is given priority, e.g. in a case where a moving image is displayed or in a case where a high image quality mode has been selected, and the refresh rate may be set low in a case where low electric power consumption is given priority, e.g. in a case where a still image is displayed or in a case where a lower electric power consumption mode has been selected.

In the preset embodiment, the display device 1 receives an instruction to change the refresh rate from an external device (e.g. the system control section 30). In accordance with this instruction, the refresh rate changing section 15 changes the refresh rate.

Once the refresh rate of the display panel 2 is changed, the components of the display device 1 come to drive the display panel 2 in accordance with the various control signals from the timing controller 12 so that the display panel 2 performs a display operation at the refresh rate thus changed.

(Drive Amount Control Section 20)

The drive amount control section 20 controls, in accordance with the ratio of scan periods to pause periods, the amount of electric charge that is supplied to each gate signal line G. By the way, the ratio of scan periods to pause periods determines the refresh rate of the display panel 2.

Specifically, for each of the plurality of gate signal lines G, the drive amount control section 20 controls the amount of electric charge that is supplied to the gate signal line G, in order that the ON/OFF ratio (duty ratio between the length of a drive period and the length of a non-drive period) of the gate signal line G is held constant. Especially, by controlling the length of a drive period of the gate signal line G, the drive amount control section 20 of the present embodiment controls the amount of electric charge that is supplied to the gate signal line G.

The "drive period of a gate signal line G" as used herein means a period during which an ON voltage (Hi level voltage) is applied to the gate signal line. Meanwhile, the "non-drive period of a gate signal line G as used herein means a period during which an OFF voltage (Lo level voltage) is applied to the gate signal line G.

(Example of Change of the Refresh Rate and an Example of Control of the Length of a Drive Period)

Figure 2:
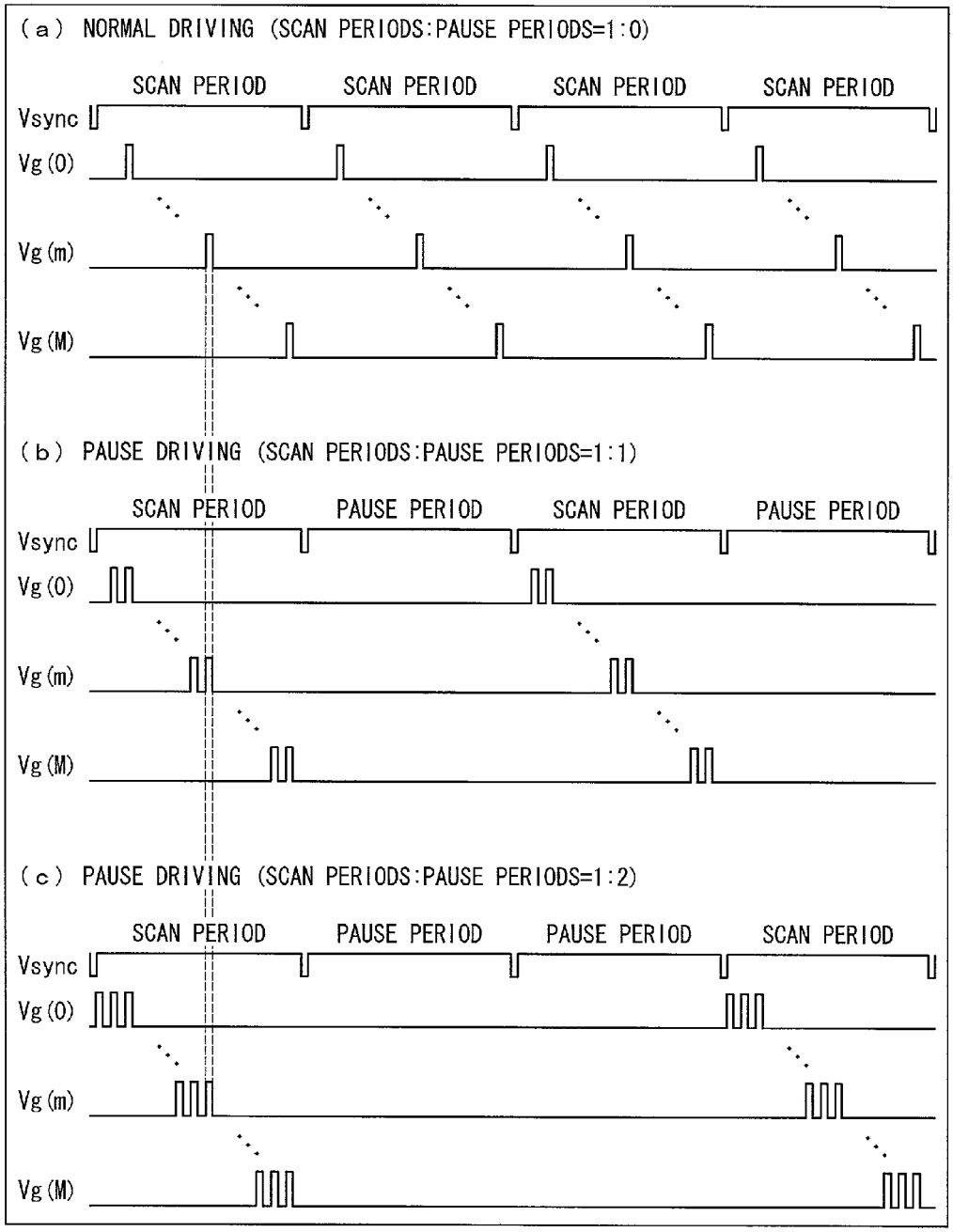
FIG. 2 is a diagram showing an example of change of the refresh rate and an example of control of the length of a drive period of each gate signal line by the display device according to Embodiment 1.

An example of change of the refresh rate and an example of control of the length of a drive period of each gate signal line G by the display device 1 according to Embodiment 1 are described below with reference to FIG. 2. FIG. 2 is a diagram showing an example of change of the refresh rate and an example of control of the length of a drive period of each gate signal line G by the display device 1 according to Embodiment 1.

(a) to (c) of FIG. 2 show configurations of frame periods and pulse waveforms of drive pulses on the gate signal lines G during the frame periods. Of (a) to (c) of FIG. 2, (a) of FIG. 2 shows a time of normal driving. Further, (b) of FIG. 2 shows a time of change of the refresh rate (to ½ of the refresh rate during normal driving). Further, (c) of FIG. 2 shows a time of change of the refresh rate (to ⅓ of the refresh rate during normal driving). The following description assumes that the refresh rate during normal driving is 60 Hz.

Meanwhile, in (a) to (c) of FIG. 2, Vsync represents the pulse waveform of a vertical synchronization signal that is generated every frame period. Further, Vg(0) represents the pulse waveform of a drive pulse on the first (leading) gate signal line G. Further, Vg(m) represents the pulse waveform of a drive pulse on the mth gate signal line G. Moreover, Vg(M) represents the pulse waveform of a drive pulse on the Mth (last) gate signal line G.

(Refresh Rate: During Normal Driving)

As shown in (a) of FIG. 2, during normal driving (i.e. in a case where the refresh rate is 60 Hz), there is provided a continuous series of frame periods, without a pause period being provided. In each scan period, the pulse number of drive pulses on each gate signal line G is "1". That is, the length of a drive period of each gate signal line G corresponds to a length of "one" pulse, and the length of a non-drive period of each gate signal line G corresponds to a length of "one" frame period (i.e. 1/60 second). That is, the ON/OFF ratio of each gate signal line G is "1:1".

(Refresh Rate: ½ of the Refresh Rate During Normal Driving)

As shown in (b) of FIG. 2, in a case where the refresh rate has been changed to ½ of the refresh rate during normal driving (i.e. 30 Hz), a scan period and a pause period are alternated so that the ratio of scan periods to pause periods is 1:1.

This causes the length of a non-drive period of each gate signal line G to be extended by "two" frame periods (i.e. to 2/60 second). Accordingly, the pulse number of drive pulses on each gate signal line G is increased to "2" under the control of the drive amount control section 20. That is, the length of a drive period of each gate signal line G is changed to a length of "two" pulses". This causes the ON/OFF ratio of each gate signal line G to be kept at "1:1", the same as it had been before the refresh rate was changed.

(Refresh Rate: ⅓ of the Refresh Rate During Normal Driving)

As shown in (c) of FIG. 2, in the case of the change of the refresh rate to ⅓ (e.g. to 20 Hz), a scan period and two pause periods are alternated so that the ratio of scan periods to pause periods is 1:2.

This causes the length of a non-drive period of each gate signal line to be extended to a period equal in length to "three" pause periods (e.g. 3/60 second). Accordingly, the pulse number of drive pulses on each gate signal line G is increased to "3" under the control the driver amount control section 20. That is, the length of a drive period of each gate signal line G is changed to a length of "three" pulses". This causes the ON/OFF ratio of each gate signal line G to be kept at "1:1", the same as it had been before the refresh rate was changed.

In summary, the display device 1 sets the pulse number to "1" in a case where the ratio of scan periods to pause periods is 1:0 (in the case of 60 Hz), sets the pulse number to "2" in a case where the ratio of scan periods to pause periods is 1:1 (in the case of 30 Hz), and sets the pulse number to "3" in a case where the ratio of scan periods to pause periods is 1:2 (in the case of 20 Hz). The display device 1 may be configured such that the pulse numbers that are applied according to the ratios may be stored in advance in a memory or the like in correspondence with the ratios, or may be calculated each time the ratios are changed.

(Effects)

As just described, the display device 1 (refresh rate changing section 15) according to the present embodiment employs a configuration in which the refresh rate of the display panel 2 is lowered by providing a pause period during which scanning of each gate signal line G is suspended.

Once the refresh rate is thus changed, the ratio of scan periods to pause periods is changed, and the display device 1 according to the present embodiment can keep the ON/OFF ratio of each gate signal line G constant by changing the pulse number of drive pulses on each gate signal line G. This enable the display device 1 according to the present embodiment to control shifts in threshold voltage of the switching elements.

In particular, since the display device 1 according to the present embodiment employs a configuration in which the ON/OFF ratio is kept constant by changing the pulse number that is to be generated, it can control the ON/OFF ratio while suppressing costs with a simple configuration.

Embodiment 2

Next, Embodiment 2 of the preset invention is described with reference to FIG. 3. In Embodiment 1, the length of a drive period of each gate signal line G is controlled by controlling the pulse number of drive pulses on each gate signal line G. In Embodiment 2, an example is described where the length of a drive period of each gate signal line G is controlled by controlling the pulse width of a drive pulse on each gate signal line G. In the following, a display device 1 according to Embodiment 2 is described solely with reference to the differences between the display device 1 according to Embodiment 2 and the display device 1 according to Embodiment 1. The other features of the display device 1 of Embodiment 2 are identical to those the display device 1 of Embodiment 1, and as such, are not described here. As with the description of Embodiment 1 (FIG. 2), the following description assumes that the refresh rate during normal driving is 60 Hz.

(Example of Change of the Refresh Rate and an Example of Control of the Length of a Drive Period)

Figure 3:
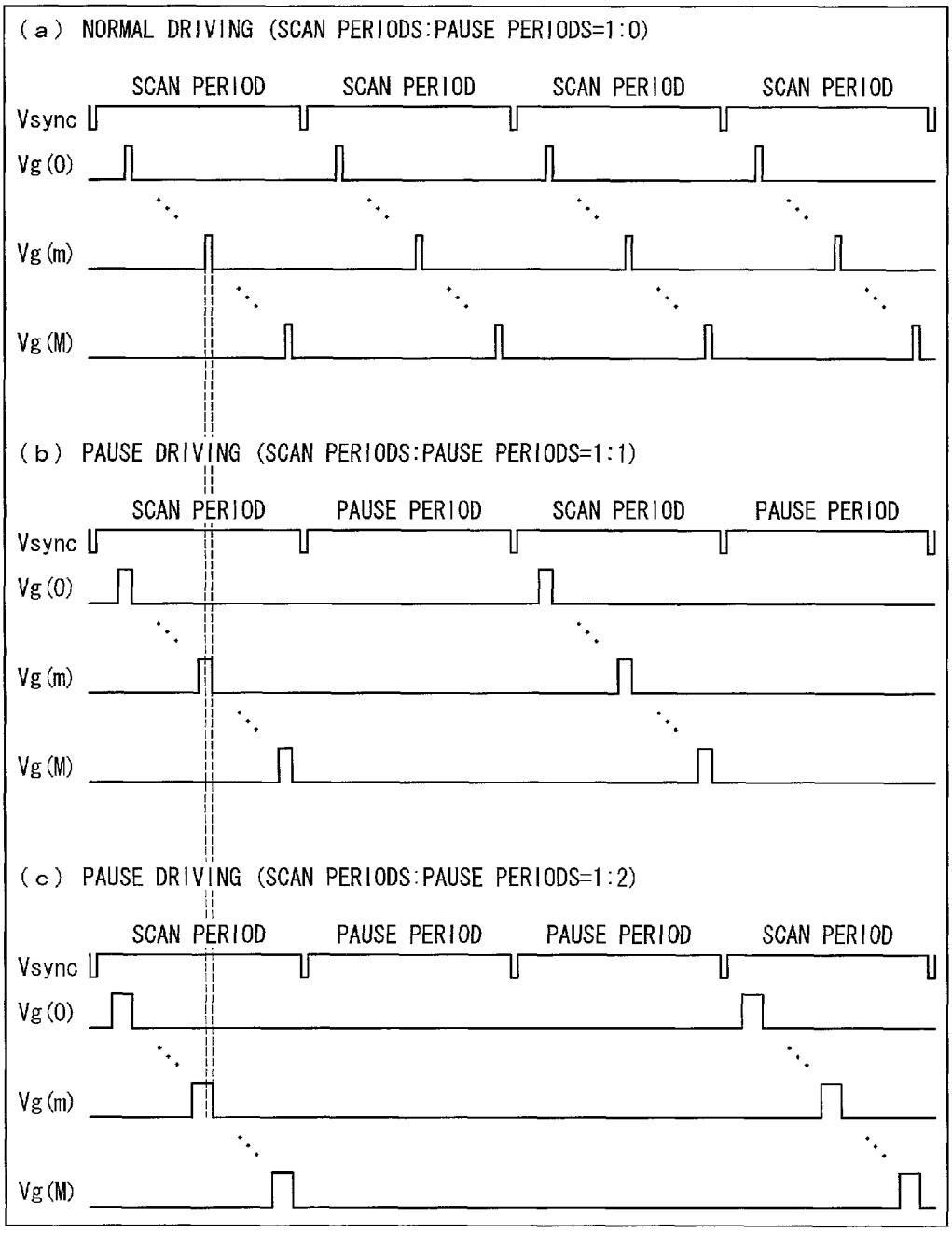
FIG. 3 is a diagram showing an example of change of the refresh rate and an example of control of the length of a drive period of each gate signal line by a display device according to Embodiment 2.

FIG. 3 is a diagram showing an example of change of the refresh rate and an example of control of the length of a drive period of each gate signal line G by the display device 1 according to Embodiment 2.

(Refresh Rate: During Normal Driving)

As shown in (a) of FIG. 3, during normal driving (i.e. in a case where the refresh rate is 60 Hz), there is provided a continuous series of frame periods, without a pause period being provided. In each scan period, the pulse width of a drive pulse on each gate signal line G corresponds to the pulse width of "one" pulse. That is, the length of a drive period of each gate signal line G corresponds to a length of "one" pulse, and the length of a non-drive period of each gate signal line G corresponds to a length of "one" frame period (i.e. 1/60 second). That is, the ON/OFF ratio of each gate signal line G is "1:1".

(Refresh Rate: ½ of the Refresh Rate During Normal Driving)

As shown in (b) of FIG. 3, in a case where the refresh rate has been changed to ½ of the refresh rate during normal driving (i.e. 30 Hz), a scan period and a pause period are alternated so that the ratio of scan periods to pause periods is 1:1.

This causes the length of a non-drive period of each gate signal line G to be extended by "two" frame periods (i.e. to 2/60 second). Accordingly, the pulse width of a drive pulse on each gate signal line G is increased to a pulse width of "two" pulses under the control of the drive amount control section 20. That is, the length of a drive period of each gate signal line G is changed to a length of "two" pulses". This causes the ON/OFF ratio of each gate signal line G to be kept at "1:1", the same as it had been before the refresh rate was changed.

(Refresh Rate: ⅓ of the Refresh Rate During Normal Driving)

As shown in (c) of FIG. 3, in the case of the change of the refresh rate to ⅓ (e.g. to 20 Hz), a scan period and two pause periods are alternated so that the ratio of scan periods to pause periods is 1:2.

This causes the length of a non-drive period of each gate signal line to be extended to a period equal in length to "three" pause periods (e.g. 3/60 second). Accordingly, the pulse width of a drive pulse on each gate signal line G is increased to a pulse width of "three" pulses under the control the driver amount control section 20. That is, the length of a drive period of each gate signal line G is changed to a length of "three" pulses". This causes the ON/OFF ratio of each gate signal line G to be kept at "1:1", the same as it had been before the refresh rate was changed.

In summary, the display device 1 sets the pulse width to a pulse width of "one" pulse in a case where the ratio of scan periods to pause periods is 1:0 (in the case of 60 Hz), sets the pulse width to a pulse width of "two" pulses in a case where the ratio of scan periods to pause periods is 1:1 (in the case of 30 Hz), and sets the pulse number to a pulse width of "three" pulses in a case where the ratio of scan periods to pause periods is 1:2 (in the case of 20 Hz). The display device 1 may be configured such that the pulse widths that are applied according to the ratios may be stored in advance in a memory or the like in correspondence with the ratios, or may be calculated each time the ratios are changed.

(Effects)

As just described, the display device 1 (refresh rate changing section 15) according to the present embodiment employs a configuration in which the refresh rate of the display panel 2 is lowered by providing a pause period during which scanning of each gate signal line G is suspended.

Once the refresh rate is thus change, the ratio of scan periods to pause periods is changed, and the display device 1 according to the present embodiment can keep the ON/OFF ratio of each gate signal line G constant by changing the pulse width of a drive pulse on each gate signal line G. This enables the display device 1 according to the present embodiment to control shifts in threshold voltage of the switching elements.

In particular, since the display device 1 according to the present embodiment employs a configuration in which the ON/OFF ratio is kept constant by changing the pulse width that is to be generated, it can finely control the ON/OFF ratio while suppressing costs with a simple configuration.

(Pixels of the Display Panel 2)

Next, the pixels of the display panel 2 of the display device 1 provided in the display device 1 according to each of the embodiments described above are described.

The display device 1 according to each of the embodiments described above employs, as a TFT in each of the plurality of pixels of the display panel 2, a TFT made of an oxide semiconductor, in particular a TFT made of so-called IGZO (InGaZnOx), which is composed of indium (In), gallium (Ga), and zinc (Zn). The following explains the advantage of a TFT made of an oxide semiconductor.

(TFT Characteristics)

Figure 4:
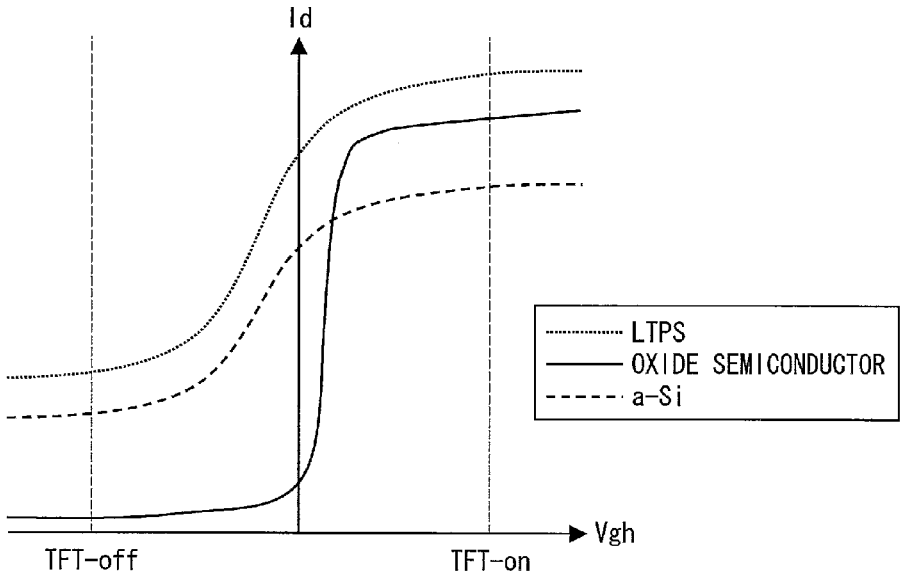
FIG. 4 is a diagram showing the characteristics of various types of TFT, including a TFT made of an oxide semiconductor.
Figure 5:
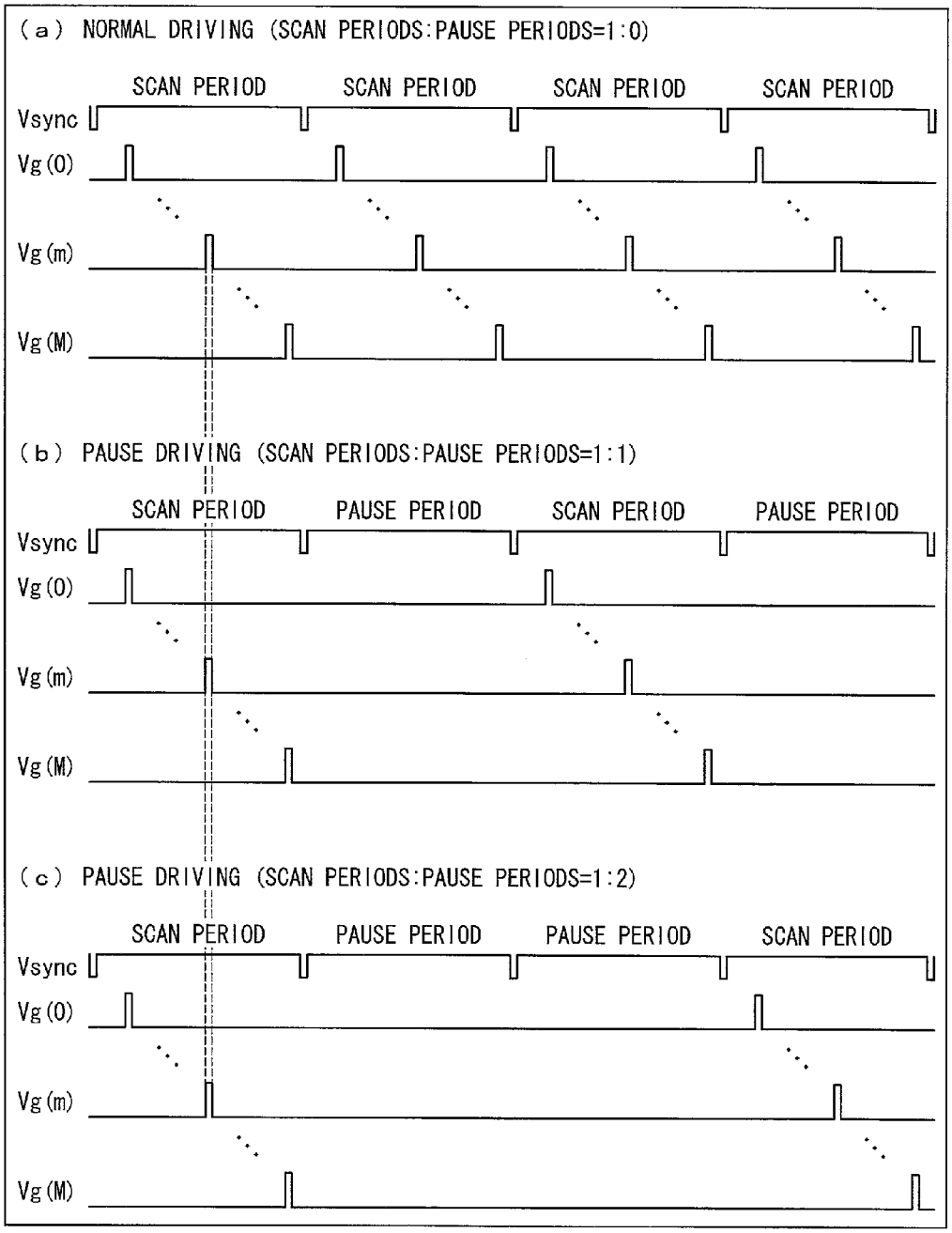
FIG. 5 is a diagram showing an example of change of the refresh rate by a conventional display device.
Figure 6:
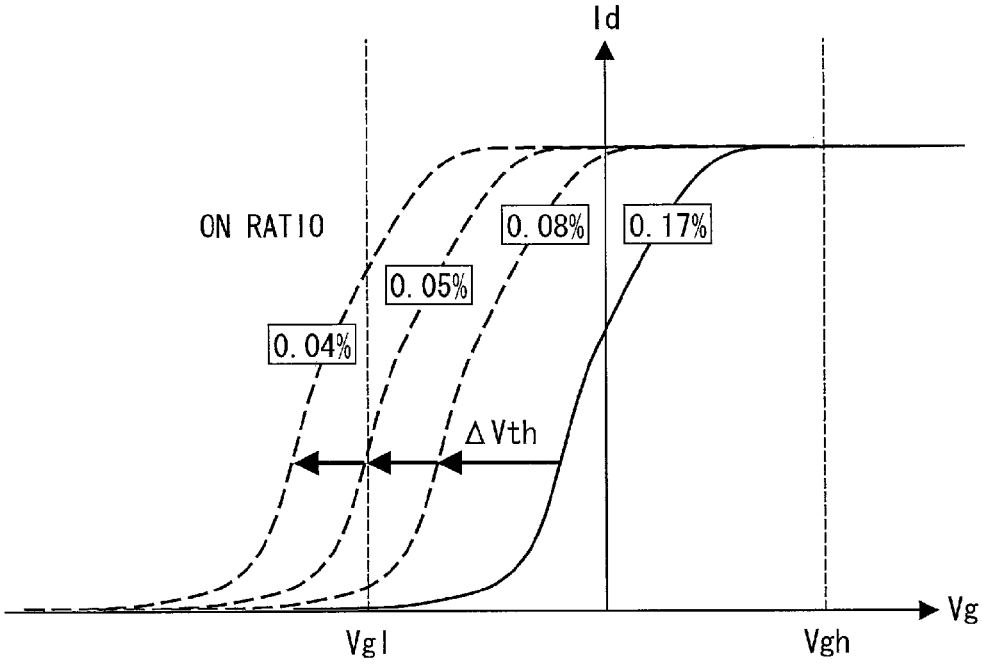
FIG. 6 is a diagram showing the characteristics of a switching element that is used in a pixel of a display panel.

FIG. 4 is a diagram showing the characteristics of various types of TFT, including a TFT made of an oxide semiconductor. FIG. 4 shows the respective characteristics of a TFT made of an oxide semiconductor, a TFT made of a-Si (amorphous silicon), and a TFT made of LTPS (low-temperature polysilicon).

In FIG. 4, the horizontal axis (Vg) represents the voltage value of ON voltage that is supplied to the gate in each of the TFTs, and the vertical axis (Id) the amount of an electric current between the source and the drain in each of the TFTs In particular, the period represented as "TFT-on" in FIG. 4 represents the ON state of a transistor that corresponds to the voltage value of ON voltage, and the period represented as "TFT-off" in FIG. 4 represents the OFF state of a transistor that corresponds to the voltage value of OFF voltage As shown in FIG. 4, a TFT made of an oxide semiconductor is higher in electron mobility in an ON state than a TFT made of a-Si.

Specifically, although not illustrated, whereas the TFT made of a-Si has an Id current of 1 uA during the period TFT-on, the TFT made of an oxide semiconductor has an Id current of about 20 to 50 uA during the period TFT-on.

This shows that the TFT made of an oxide semiconductor is about 20 to 50 times higher in electron mobility in an ON state than the TFT made of a-Si and is therefore vastly superior in ON characteristics.

Further, as shown in FIG. 4, the TFT made of an oxide semiconductor is lower in leak current in an OFF state than the TFT made of a-Si.

Specifically, although not illustrated, whereas the TFT made of a-Si has an Id current of 10 pA during the period TFT-off, the TFT made of an oxide semiconductor has an Id current of about 0.1 pA during the period TFT-off.

This shows that the TFT made of an oxide semiconductor is about 1/100 as high in electron mobility in an ON state as the TFT made of a-Si and is therefore vastly superior in OFF characteristics, with a leak current hardly occurring.

The display device 1 of each of the embodiments described above employs such a TFT made of an oxide semiconductor (in particular, IGZO) in each of the pixels.

This causes the display device 1 of each of the embodiments described above to be superior in term of the ON characteristics of the TFT in each pixel, thus making it possible to drive a pixel with a smaller TFT. This makes it possible to reduce the percentage of the amount of space that is occupied by the TFT in each pixel. That is, this makes it possible to increase the aperture ratio in each pixel and increase the transmittance of backlight. This in turn makes it possible to employ a low-power-consumption backlight and suppress the luminance of the backlight, thus making it possible to reduce electric power consumption.

Further, since the display device 1 of each of the embodiments described above is superior in term of the ON characteristics of the TFT in each pixel, it is also possible to shorten the time required to write a source signal to each pixel. This makes it possible to easily increase the refresh rate of the display panel 2.

Furthermore, since the display device 1 of each of the embodiments described above is superior in term of the OFF characteristics of the TFT in each pixel, it is possible to maintain for a long time a state where the respective source signals are written to the plurality of pixels of the display panel. This makes it possible to easily lower the refresh rate of the display panel 2 while maintaining high display image quality.

MODIFICATIONS

Modifications of the embodiments are described below.

Modification 1

In each of the embodiments, the display device 1 changes the refresh rate in accordance with an instruction from the external device. However, this does not imply any limitation. For example, the display device 1 may change the refresh rate by itself on the basis of the content of video data to be displayed.

In this case, for example, the display device 1 may store video data in a frame memory and change the refresh rate on the basis of the video data stored in the frame memory. Alternatively, the display device 1 may store a condition for the change of the refresh rate in advance in a memory or the like and change the refresh rate on the basis of the condition for the change. Further, there may be various conditions for the change of the refresh rate. For example, the display device 1 may calculate the amount of movement of video data using a publicly-known technology and lower the refresh rate in a case where the amount of movement is small or raise the refresh rate in a case where the amount of movement is large.

Alternatively, it is possible to change the refresh rate by calculating, for each frame, the sum of pixels values as a check sum value and comparing this check sum value with the check sum value obtained for the previous frame. For example, in a case where the difference between check sum values is equal to or greater than an upper-limit threshold value, the refresh rate may be raised, and in a case where the difference between check sum values is equal to or less than a lower-limit threshold value, the refresh rate may be lowered.

Modification 2

In each of the embodiments, the display device 1 keeps the ON/OFF ratio of each switching element constant by controlling the length of a drive period of each gate signal line G (i.e. the pulse number of drive pulses or the pulse width of a drive pulse). This does not imply any limitation. For example, the display device 1 can bring about the same effect as that which is brought about by keeping the ON/OFF ratio of each switching element constant by controlling the drive voltage (at least either an ON voltage or an OFF voltage) of each pixel.

Keeping the ON/OFF ratio of each switching element constant means keeping the ratio of a first amount of electric charge to a second amount of electric charge constant. The first amount of electric charge is an amount of electric charge that is supplied to a pixel when the switching element is in an ON state, and the second amount of electric charge is an amount of electric charge that is supplied to a pixel when the switching element is in an OFF state. Assuming that S1 is the first amount of electric charge and S2 is the second amount of electric charge, S1 and S2 are calculated according to the following equations (1) and (2), respectively:

$$S1 = Vgon \times Ton \quad (1),$$

where Ton is the length of a drive period over which writing is performed once (period during which an ON voltage is applied), and Vgon is the value of voltage that is applied to the pixel during the drive period; and $$S2 = Vgoff \times Toff \quad (2),$$

where Toff is the length of a non-drive period over which writing is performed once (period during which an OFF voltage is applied), and Vgoff is the value of voltage that is applied to the pixel during the non-drive period.

Keeping the ON/OFF ratio of each switching element constant can be considered as keeping S2/S1 constant. From this point of view, for example, in a case where S2 increases due to an extension of the non-drive period (i.e. the period Toff), S1/S2 can be kept constant by increasing Si accordingly.

In this case, S1 can be increased not only by extending the drive period (i.e. the period Torr), but S1 can also be increased by increasing the voltage value Vgon.

Further, even when S2 increases due to an extension of the non-drive period (i.e. the period Toff), S1/S2 can be kept constant by offsetting the increase by decreasing the voltage value Vgoff accordingly.

In any case, the display device 1 can bring about the same effect as that which is brought about by keeping the ON/OFF ratio of each switching element constant, and can therefore prevent one of the reliability problems, i.e. shifts in threshold voltage of the switching elements.

As just described, the display device 1 (drive amount control section 20) of Modification 2 can control the first amount of electric charge (S1) by so controlling the value of ON voltage (Vgon) which is applied to each of the plurality of pixels that the ratio of the first amount of electric charge (S1), which is an amount of electric charge that is supplied to a pixel in a drive period during which the pixel is driven, to the second amount of electric charge (S2), which is an amount of electric charge that is supplied to a pixel in a non-drive period other than the drive period, is kept constant both prior to and subsequent to the change of the refresh rate.

This allows the display device 1 of Modification 2 to keep the ratio of the first amount of electric charge (S1) to the second amount of electric charge (S2) in each pixel by controlling the ON voltage value of the pixel. This brings about the same effect as that which is brought about by keeping the ON/OFF ratio of each switching element constant, without changing the ON/OFF ratio of each switching element.

Further, the display device 1 (drive amount control section 20) of Modification 2 can also control the second amount of electric charge (S2) by so controlling the value of OFF voltage (Vgoff) which is applied to each of the plurality of pixels that the ratio of the first amount of electric charge (S1), which is an amount of electric charge that is supplied to a pixel in a drive period during which the pixel is driven, to the second amount of electric charge (S2), which is an amount of electric charge that is supplied to a pixel in a non-drive period other than the drive period, is kept constant both prior to and subsequent to the change of the refresh rate.

This allows the display device 1 of Modification 2 to keep the ratio of the first amount of electric charge (S1) to the second amount of electric charge (S2) in each pixel by controlling the OFF voltage value of the pixel. This brings about the same effect as that which is brought about by keeping the ON/OFF ratio of each switching element constant, without changing the ON/OFF ratio of each switching element.

(Supplementary Explanation)

The present invention is not limited to the description of the embodiments above, but may be altered by a skilled person within the scope of the claims. An embodiment based on a proper combination of technical means disclosed in different embodiments is encompassed in the technical scope of the present invention.

For example, the various set values of the refresh rate shown in the embodiments are mere examples. As such, these set values can of course be changed to appropriate values according to the characteristics of the display devices, the intended use, etc.

Further, the ON/OFF ratio of each gate signal line may be kept constant by any combination of the following methods: the change of the pulse width as explained in Embodiment 1; the change of the pulse number as explained in Embodiment 2; the change of the voltage value Vgon as explained in Modification 2; and the change of the voltage value Vgoff as explained in Modification 2.

For example, the ON/OFF ratio of each gate signal line can be kept constant both prior to and subsequent to the change of the refresh rate by a combination of the change of the pulse width as explained in Embodiment 1 and the change of the pulse number as explained in Embodiment 2. For example, in a case of tripling a drive period of a gate signal line when the drive period is defined with a pulse width of "1" and a pulse number of "1", the pulse width may be changed to "3" with the pulse number kept at "1". Alternatively, the pulse number may be changed to "3" with the pulse width kept at "1". Alternatively, the pulse number may be changed to "2" with the pulse width changed to "1.5".

Further, for example, in a case where the drive period is increased 1.5 times as long, the pulse width may be changed to "1.5" with the pulse number kept at "1". Alternatively, the pulse number may be changed to "2" with the pulse width changed to "0.75".

Further, although each of the embodiments has been described with reference to an example where the present invention is applied to a display device employing, in each pixel, a TFT made of an oxide semiconductor (in particular, IGZO), this does not imply any limitation. For example, the present invention can also be applied to a display device employing, in each pixel, another type of TFT such as a TFT made of a-Si or a TFT made of LTPS.

Each of the embodiments has been described with reference to an example where the refresh rate is lowered. Of course, however, the display device 1 of each of the embodiments can also raise the refresh rate by increasing the number of scan periods per unit time. In this case, to the contrary of the case where the refresh rate is lowered, the display device 1 can keep the ON/OFF ratio of each switching element constant by reducing the number of drive periods of each gate signal line G through reducing the pulse number of drive pulses on each gate signal line G or narrowing the pulse width. This allows the display device 1 to suppress shifts in threshold voltage of the switching elements.

(Summary)

As described above, a drive device according to the present invention is a drive device for driving a display panel having a plurality of pixels, including: refresh rate changing means for changing a refresh rate of the display panel by configuring settings for scan periods during each of which a plurality of gate signal lines of the display panel are sequentially scanned and for pause periods during each of which sequential scanning of the plurality of gate signal lines is suspended; and drive amount control means for controlling, in accordance with a ratio of the scan periods to the pause periods, drive time during which each of the gate signal lines is driven in each of the scan periods.

This drive device makes it possible to, even when having changed the refresh rate of the display panel, change the ON/OFF ratio of each switching element to a more appropriate one by controlling, in accordance with the ratio of the scan periods to the pause periods, the drive time of each of the gate signal lines in each of the scan periods. With this, this drive device makes it possible to prevent one of the reliability problems, i.e. shifts in threshold voltage of the switching elements.

Further, the drive device is preferably configured such that for each of the plurality of gate signal lines, the drive amount control means so controls drive time during which the gate signal line is driven that a ratio of the drive time of the gate signal line to non-drive time other than the drive time of the gate signal line is kept constant both prior to and subsequent to a change of the refresh rate.

Keeping the ratio of the drive time to the non-drive time constant brings about the same effect as that which is brought about by keeping the ON/OFF ratio of each switching element constant. Therefore, this configuration makes it possible to surely suppress shifts in ON/OFF threshold of each switching element. Even if the ratio of the drive time to the non-drive time is not kept completely constant, the control is encompassed in the scope of "controls . . . is kept constant", as long as it is such control that a variation in ON/OFF threshold falls within a permissible range.

Further, the drive device is preferably configured such that for each of the plurality of gate signal lines, the drive amount control means controls a pulse width of a drive pulse on the gate signal line and thereby controls drive time of the gate signal line.

This configuration makes it possible to control the amount of electric charge with a comparatively simple configuration, thus making it possible to change the ON/OFF ratio of each switching element to a more appropriate one while suppressing cost increases. Further, since it is possible to control the amount of electric charge in a non-step manner, it is possible to finely adjust the ON/OFF ratio of each switching element.

Further, the drive device is preferably configured such that for each of the plurality of gate signal lines, the drive amount control means controls a pulse number of drive pulses on the gate signal line and thereby controls drive time of the gate signal line.

This configuration makes it possible to control the amount of electric charge with a comparatively simple configuration, thus making it possible to change the ON/OFF ratio of each switching element to a more appropriate one while suppressing cost increases.

Further, a display device according to the present embodiment includes: a display panel having a plurality of pixels; and the drive device.

This display device makes it possible to provide a display device that brings about the same effect as the drive device.

The display device is preferably configured such that each of the plurality of pixels has a switching element whose semiconductor layer is made of an oxide semiconductor. In particular, the display device is preferably configured such that the oxide semiconductor is an oxide composed of indium (In), gallium (Ga), and zinc (Zn).

This configuration makes each of the pixels to be vastly superior in both ON characteristics and OFF characteristics, and makes it possible to easily greatly increase and reduce the refresh rate. This raises the need for eliminating a variation in ON/OFF threshold value that is likely to take place along with change of the refresh rate. For this reason, application of a display device of the present embodiment in such a display device can bring about a more useful effect.

INDUSTRIAL APPLICABILITY

A drive device and a display device according to the present invention is applicable to various types of so-called matrix display device in which the respective switching elements of a plurality of pixels arranged in a matrix manner are driven by rows of pixels by sequentially scanning a plurality of gate signal lines.

REFERENCE SIGNS LIST

1 Display device
2 Display panel
10 Display drive circuit (drive device)
12 Timing controller
14 Scanning line drive circuit
15 Refresh rate changing section (refresh rate changing means)
16 Signal line drive circuit
18 Common electrode drive circuit
20 Drive amount control section (drive amount control means)
28 Power-generating circuit
30 System-side control section

The invention claimed is:

1. A drive device for driving a display panel having a plurality of pixels, comprising:

a timing controller that:

changes a refresh rate of the display panel by configuring settings for scan periods during each of which a plurality of gate signal lines of the display panel are sequentially scanned and for pause periods during each of which sequential scanning of the plurality of gate signal lines is suspended; and controls, in accordance with a ratio of the scan periods to the pause periods, a pulse width of a drive pulse on each of the gate signal lines and a drive time during which each of the gate signal lines is driven in each of the scan periods.

2. The drive device as set forth in claim 1, wherein for each of the plurality of gate signal lines, the timing controller controls the drive time during which the gate signal line is driven that a ratio of the drive time of the gate signal line to non-drive time other than the drive time of the gate signal line is kept constant both prior to and subsequent to a change of the refresh rate.

3. The drive device as set forth in claim 1, wherein for each of the plurality of gate signal lines, the timing controller controls the drive time of the gate signal line such that the drive time increases as the ratio of the scan periods to the pause periods decreases.

4. The drive device as set forth in claim 1, wherein a pulse waveform of a vertical synchronization signal is generated every frame period; and the scan periods each include one or more frame periods and the pause periods each include one or more frame periods.

5. A display device comprising:

a display panel having a plurality of pixels; and a drive device as set forth in claim 1.

6. The display device as set forth in claim 5, wherein each of the plurality of pixels has a switching element whose semiconductor layer is made of an oxide semiconductor.

7. The display device as set forth in claim 6, wherein the oxide semiconductor is an oxide composed of indium (In), gallium (Ga), and zinc (Zn).

* * * * *